United States Patent [19]

Roethel

[11] Patent Number: 4,621,750

[45] Date of Patent: Nov. 11, 1986

[54] DISPENSER VALVE

[75] Inventor: Henry G. Roethel, Bedford Heights, Ohio

[73] Assignee: The Meyer Company, Cleveland, Ohio

[21] Appl. No.: 722,402

[22] Filed: Apr. 12, 1985

[51] Int. Cl.[4] ..... B67D 3/00

[52] U.S. Cl. ..... 222/505; 222/517; 251/347

[58] Field of Search ..... 222/505, 508, 511, 517, 222/518, 512, 513, 556, 566, 105; 251/331, 341, 347, 348

[56] References Cited

U.S. PATENT DOCUMENTS

| | | | |
|---|---|---|---|
| 1,837,552 | 12/1931 | Kelly | 222/511 |
| 2,021,731 | 11/1935 | Leins | 222/511 |
| 3,052,386 | 9/1962 | Martorelli | 222/517 |
| 3,595,445 | 7/1971 | Buford | 222/213 |
| 3,972,452 | 8/1976 | Welsh | 222/501 |
| 4,029,295 | 6/1977 | Wassmer | 251/331 X |
| 4,169,548 | 10/1979 | Bond | 222/505 |
| 4,211,348 | 7/1980 | Scholle | 222/498 |
| 4,226,343 | 10/1980 | Fling | 222/504 |
| 4,248,362 | 2/1981 | Welsh et al. | 222/505 |
| 4,264,019 | 4/1981 | Roberts et al. | 222/105 X |
| 4,386,720 | 6/1983 | Speedie | 222/498 |

*Primary Examiner*—Jospeh J. Rolla
*Assistant Examiner*—Jay I. Alexander
*Attorney, Agent, or Firm*—Fay, Sharpe, Fagan, Minnich & McKee

[57] ABSTRACT

A valve for dispensing fluid products includes a valve body comprised of a first portion including a first open ended passageway therethrough, and a second portion having a second passageway open at a first end and substantially closed at a second end. A port in the side wall of the second portion is disposed so that the first and second passageways are disposed in fluid communication with each other. A handle is operatively connected to the body and extends partially into the second passageway. A generally tube-like seal member is closely housed in the second passageway and is adapted to close the port for blocking fluid communication between the two passageways. The seal member is selectively shiftable by the handle between a first, normal position in blocking relation to the port and a second position in spaced relation to the port. The valve body and handle may be integrally molded with each other from a plastic material.

26 Claims, 8 Drawing Figures

FIG. 3A
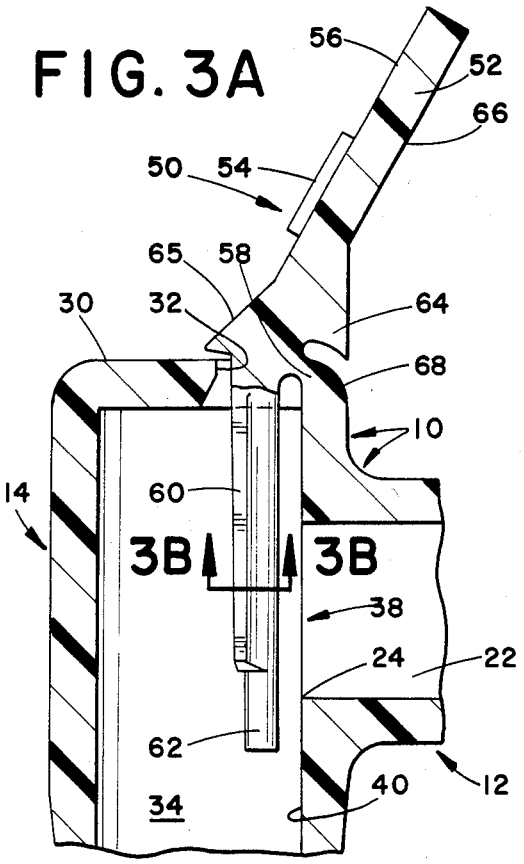
FIG. 5
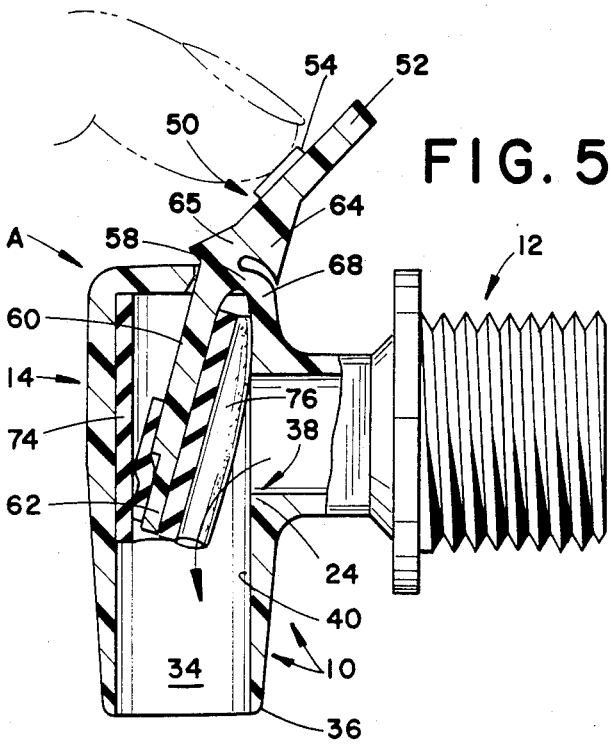
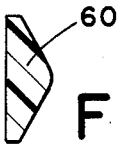
FIG. 3B
FIG. 6
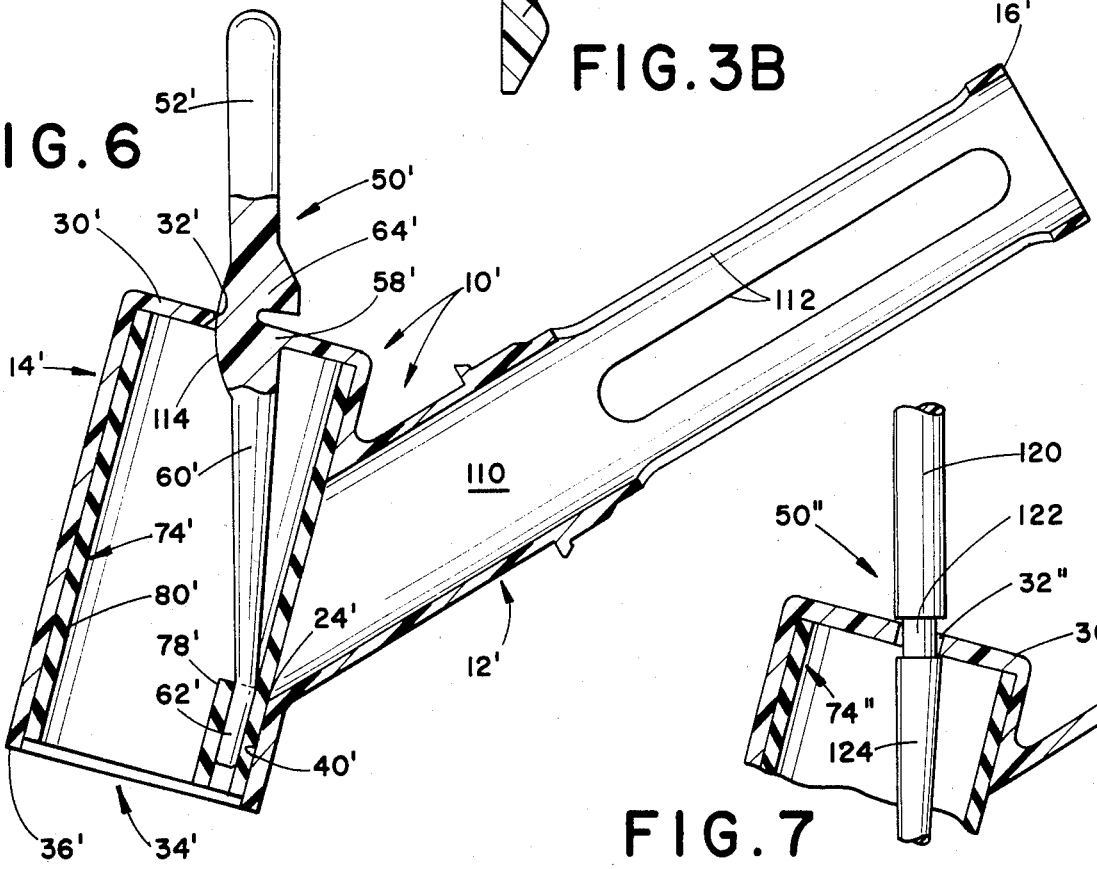
FIG. 7

DISPENSER VALVE

BACKGROUND OF THE INVENTION

This invention generally pertains to dispenser valves. More specifically, the invention relates to a self-closing dispenser valve or tap useful for dispensing various flowable products.

The invention is particularly applicable to dispensing valves for throwaway containers, such as "bag-in-the-box" or "membrane" type containers, and will be described with particular reference thereto. However, it will be appreciated by those skilled in the art that the invention has broader applications and may also be adapted to use in many other environments where the availability of a simple, low cost dispensing valve would be desirable.

Bag-in-the-box or membrane packaging of a variety of commodities is becoming increasingly popular due to its economy, convenience, and storage capabilities. Such packaging is entirely disposable and typically includes a flexible plastic bag which receives a flowable product in a sterile environment. A paperboard box is typically used for enclosing the filled bag to facilitate safe transportation and handling. Examples of commodities economically packaging in this manner include free-flowing fluids such as milk, juice and wine, and viscous products, such as ketchup, cooking oil and detergents. The packaging is generally available in a variety of sizes, eg., 1, 3, 5 and/or 10 gallons.

A valve or tap is provided on the container to facilitate controlled dispensing of the container contents. One conventional valve includes a flexible walled tube having an opening at the base area thereof which communicates with the interior of the container. The flexible tube defines a sealing surface and is received in an outlet housing disposed generally at right angles to the axis of the container opening. An axially projecting toggle allows the user to distort the flexible tube, i.e., the sealing surface, and form a liquid flow passage from the container to the outlet housing. When the toggle is not deflected, the walls of the flexible tube are urged into covering relation with the outlet housing to prevent the flow of liquid. The toggle is formed integrally with the flexible tube itself.

Such prior art type valves, however, suffer from several disadvantages, the major one being their cost. Conventional valves for disposable packaging are fairly expensive, although it is desired that they be as low cost as possible. Moreover, most prior valves of this general type also experience problems with sealing effectiveness and pressure capacity. That is, most prior art valves use little more than a line contact to seal the product in the container. Therefore, if any nicks or deformities occur during manufacture of the valve and/or the bag, unacceptable leakage will oftentimes occur. Any effort to overcome these problems involves a significant increase in the amount of material used in constructing the valve and a corresponding increase in the valve cost.

Accordingly, it has been considered desirable to develop a new and improved valve or tap which would overcome the foregoing difficulties and others while providing better and more advantageous overall results.

BRIEF SUMMARY OF THE INVENTION

In accordance with the present invention, a new and improved dispensing valve is provided which minimizes design complexity and manufacturing cost.

More particularly in accordance with the invention, the valve includes a body having a first portion with an open ended first passageway extending therethrough, and a second portion with a second passageway open at a first end and substantially closed at a second end. The side wall of the second passageway includes a port therethrough disposed for placing the two passageways in fluid communication with each other. A handle is operatively associated with the body and extends at least partially into the second passageway. A flexible seal member is disposed in the second passageway in covering relation to the port. The seal member is operatively connected to the handle for selective shifting between a normal, fluid flow blocking condition with the port and a second, fluid flow permitting condition.

In accordance with another aspect of the invention, the handle includes a manipulating portion located outside the body second portion and an elongated finger portion extending into the second passageway. A pivot area is located between the handle and valve body generally at the substantially closed second end of the second passageway.

According to one preferred construction of the invention, the valve body and handle are integrally formed with each other. According to another preferred construction, the handle comprises a separate component inserted through an aperture in the substantially closed end of the second passageway.

According to a further aspect of the invention, the seal member has a generally tubular conformation and is dimensioned to be closely received in the second passageway so that an interference relationship is established therebetween.

In accordance with a still further aspect of the invention, the tubular seal member is provided with a loop on the interior thereof adapted to receive the finger portion of the handle. Pivotal movement of the handle thus moves the seal away from and toward the port in the second passageway for controlling fluid flow through the valve.

According to still another aspect of the invention, the handle manipulating portion includes means adapted to engage the valve body and serve as a handle stop in at least the valve open condition. In one construction of the valve, means are included for limiting handle movement relative to the valve body in both the valve open and closed conditions.

In accordance with yet another aspect of the invention, the body first portion includes an exteriorly threaded section with a radial flange or stop adjacent the axial inner end thereof. A nut and seal means are receivable on the threaded section to facilitate mounting of the valve to associated structure in fluid sealing relation thereto.

In accordance with still another aspect of the invention, the valve body and the tubular seal member are both constructed of plastic. Preferably, the body is comprised of polypropylene and the seal member is comprised of a thermoplastic elastomer.

The principal advantage of the present invention is the provision of a dispensing valve which is simple in design and inexpensive to manufacture.

Another advantage of the invention resides in a dispensing valve construction wherein the valve body and operating handle may be integrally formed with each other.

A further advantage of the invention is found in a dispensing valve construction which is adapted to use in a wide variety of different environments and applications.

Still another advantage of the invention is the provision of a dispensing valve which is free of friction and wear effects, and also provides tight sealing while being capable of use at a wide range of operating temperatures.

Still other benefits and advantages of the invention will become apparent to those skilled in the art upon a reading and understanding of the following detailed specification.

BRIEF DESCRIPTION OF THE DRAWINGS

The invention may take physical form in certain parts and arrangements of parts, preferred and alternate embodiments of which will be described in detail in this specification and illustrated in the accompanying drawings which form a part hereof, and wherein:

FIG. 3A is an enlarged view of a portion of the valve of FIG. 2;

FIG. 3B is an enlarged cross-sectional view of the handle finger portion taken generally along lines 3B—3B of FIG. 3A;

FIG. 5 is a side elevational view in partial cross-section showing the dispenser valve of FIG. 1, in an open position;

FIG. 6 is a side elevational view in cross-section of an alternate embodiment of the subject new dispensing valve; and, FIG. 7 is a partial view similar to FIG. 6 for showing an alternate handle arrangement.

DETAILED DESCRIPTION OF THE PREFERRED AND ALTERNATE EMBODIMENTS

Figure 1:
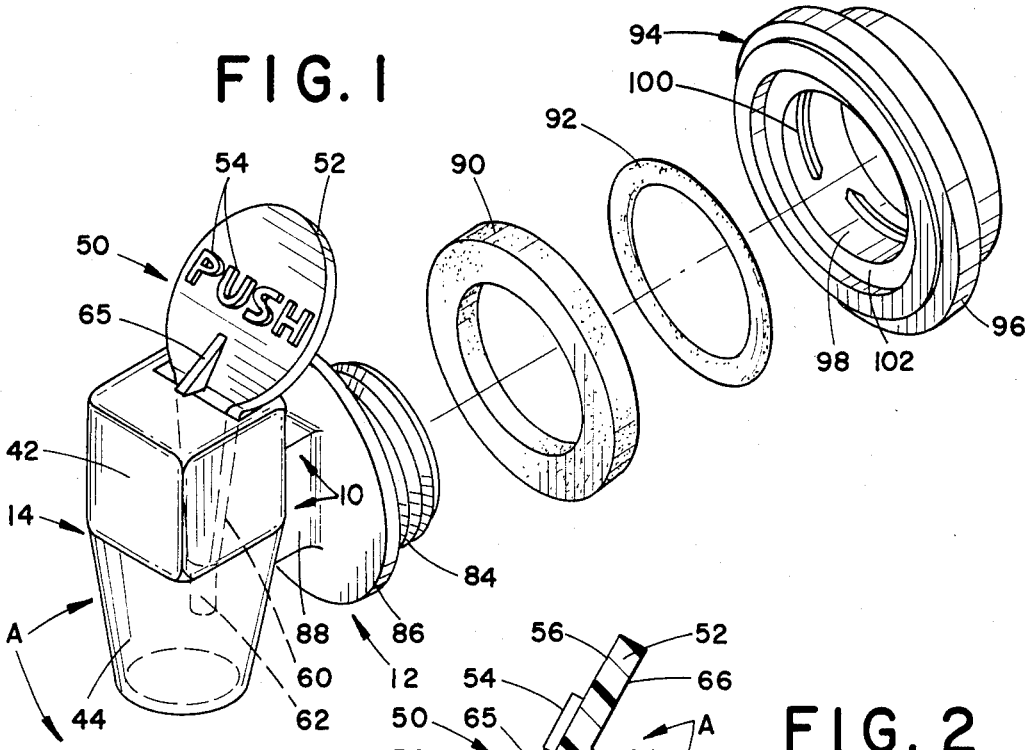
FIG. 1 is an exploded perspective view of a preferred embodiment of the subject new dispenser valve construction.

Referring now to the drawings, wherein the showings are for purposes of illustrating preferred and alternate embodiments of the invention only and not for purposes of limiting same, FIG. 1 shows the subject new dispenser valve A. While the valve is primarily designed for and will hereinafter be described in conjunction with disposable bag-in-the-box or membrane type fluid containers, it will be appreciated that the overall inventive concept involved could be adapted to use in other dispensing environments as well.

Figure 2:
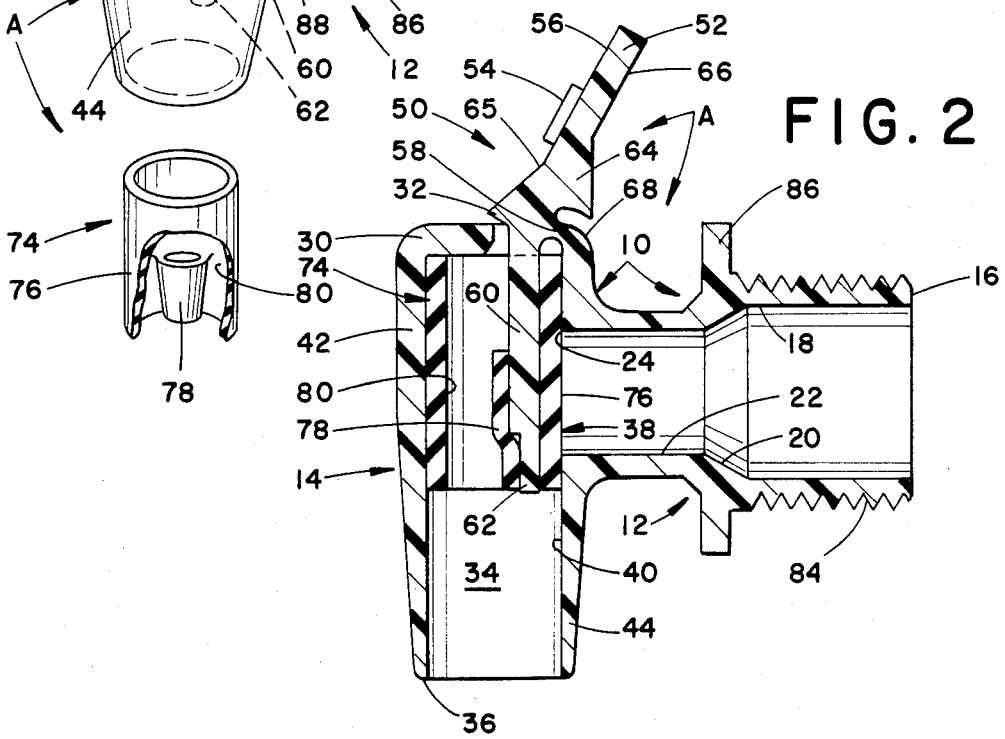
FIG. 2 is a side elevational view in cross-section showing the dispenser valve of FIG. 1 in a closed position.

More particularly, and with reference to FIGS. 1 and 2, the valve A includes a valve body 10 comprised of a first portion 12 and a second portion 14. These two portions are disposed at some angular relationship with respect to each other, and the right angle relationship best shown in FIG. 2 is generally preferred. The first portion 12 includes a first end 16 having a bore or opening 18 of a first diameter. The bore 18 leads to a connecting portion or area 20 which connects the first diameter bore or opening 18 to a second, smaller diameter bore or opening 22 extending to a second end 24 of the first tubular member. Bores 18, 22 define an open ended first passageway through body first portion 12.

The body second portion 14 has a first end 30 which is substantially closed except for a small aperture 32 therein. The aperture 32 communicates with a longitudinal bore or opening 34 which extends through the second portion to a second end 36 thereof and defines a second passageway. A through port 38 in side wall 40 of the second passageway is located at the area of first portion second end 24 so as to place the first and second passageways in fluid communication with each other. An upper portion 42 of the outer periphery of the body second portion has a squared-off appearance while a lower portion 44 has a tapered appearance. The bore 34, however, has a constant diameter, although other configurations are also possible without departing from the scope and intent of the invention.

A handle 50 is integrally formed with the body 10 and includes a planar manipulating or tab portion 52 having a plurality of friction-providing ridges or ribs 54 on the upper face 56 thereof. In the preferred arrangement shown, ridges 54 take the form of letters which spell the word "PUSH" (FIG. 1. When a finger is used to move the tab 52 for actuating the valve, the ridges prevent inadvertent slippage of the finger relative to the tab (FIG. 5). Other slippage protection means and/or indicating indicia may be included on manipulating portion upper face 56 as may be desired or convenient from a manufacturing viewpoint. An integral hinge portion 58 is disposed below the tab 52 for operatively connecting the handle to the valve body 10 at the second portion 14.

With reference now to FIGS. 3A and 3B, handle 50 has a substantially triangular, elongated finger or stem portion 60 extending into the second passageway defined by bore 34. The finger or stem portion 60 has a slightly decreasing cross-section toward its free end and is provided with a smaller, constant diameter tip portion 62 adjacent the free end. A stop member or protruding area 64 extends outwardly from lower surface 66 of the tab 62 and is cooperable with an outer surface 68 of the body second portion 14 for limiting movement of the tab in a rearward direction. That is, as shown in FIG. 5, stop member 64 prevents over-travel with resultant straining of the hinge 58 in the valve open position. The stop 64 may comprise a flange or wedge which is disposed generally normal to the lower surface of the tab. A similar stop 65 is included an upper face 56 of handle manipulating portion 52 for cooperation with first end 30 of valve body second portion 14. Stop 65 advantageously prevents over-travel with resultant straining of hinge 58 in the valve closed position. It will be appreciated, however, that appropriate stops or protrusion areas could be provided on the valve body instead of on the handle. As best shown in FIG. 3A, hinge 58 is formed so that the handle normally assumes its valve closed condition with finger portion 60 spaced toward the area of bore 34 which includes port 38.

Figure 4:
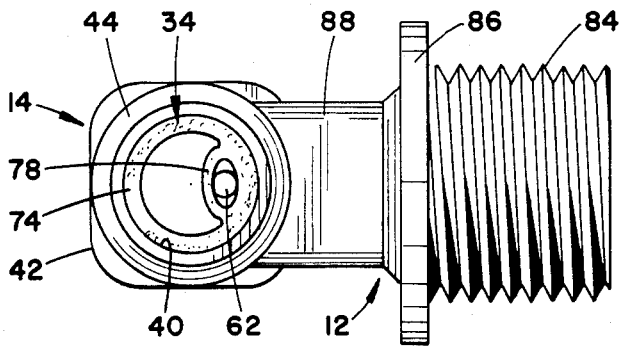
FIG. 4 is a bottom view of the valve of FIG. 2.

With reference now also to FIG. 4, a resilient, tubular seal member 74 is positioned in the upper end of the bore 34. This seal member has a length which is sufficient to close off the port 38 and block communication between the first and second passageways. The seal member 74 has an outer periphery 76 disposed in close contacting relation to the side wall 40 of bore 34 and is retained therein by an interference fit occasioned by a small difference between the outer diameter of the seal member and the diameter of the bore. Such interference fit also furnishes a force for aiding in the sealing or port 38 by urging seal outer wall 76 outwardly against bore side wall 40 around the port. The tubular seal 74 may have a wall thickness of approximately 0.105 inches or so so as to be wholly capable of making an effective closure while not being susceptible to tearing caused by seal member flexure. It is to be appreciated, of course, that a variety of other dimensional relationships for achieving the interference fit relationship and for the wall thickness of seal 74 may be suitably employed without in any way departing from the overall inventive concept involved.

The tubular seal 74 is also provided with an integral loop portion 78 on the inner periphery 80 thereof. This loop provides means for connecting the seal 74 to the handle and is adapted to cooperate with the finger or stem 60 of the handle. That is, an axial section of finger 60 adjacent the free end thereof, including the narrowed portion 62, is received in the loop to facilitate selective opening of the seal member (FIG. 5) through application of a push type force against manipulating portion 52 and thereby provide a flow path from the first passageway in body first portion 12 to the second passageway in body second portion 14, as indicated by the flow arrow f. The loop portion 78 is preferably positioned axially along the seal member interior so as to be in generally opposed relation to port 38. This relationship allows easy shearing type movement of the seal away from the seal when desired. As used in the subject specification and claims, the terms "shear" or "shearingly" are intended to rely on the physics definition of "shear", i.e., the lateral deformation produced in a body by an external force, expressed as the ratio of the lateral displacement between two points lying in parallel planes to the vertical distance between the planes.

When a push type force on handle 50 is released, natural or original orientation of hinge 58 and the inherent resiliency of seal member 74 cause the seal member to shift back into contact with the side wall 40 in a closing or sealing relation with port 38. Because of the above-noted interference fit, the seal member closes the port in drip-free manner. Also, because a resilient, cylindrical seal member 74 is provided in bore 34, the valve is self-seating as well as being leak proof.

The outer periphery of the body first portion 12 is provided with an externally threaded section 84, a radial flange or collar 86 adjacent the inner end of section 84, and an unthreaded portion defined by a plurality of flat faces 88. Faces 88 are adapted to accommodate a conventional wrench (not shown) as may be necessary to facilitate valve installation. Threaded potion 84 may be about 0.75 inches in diameter, although other diameters also could be satisfactorily employed. As shown in the drawings, faces 88 give a substantially square appearance to the unthreaded portion of body first portion 12, and each face may have a width of about 0.5 inches or so. In the embodiment shown, second bore 22 of the body first portion also has a substantially square cross-section. The flange 86 may have a diameter of approximately 1.0 inch and serves as a stop to limit movement of valve body 10 into an associated container.

A washer 90 and an O-ring seal or a singular tapered washer 92 are adapted for receipt on the outer periphery of threaded section 84 in abutting relation to flange 86. A nut 94 having a flange 96 at one end thereof is adapted for threaded receipt onto threaded section 84. A bore 98 in the nut has one turn of a standard profile female thread 100 projecting from the inner wall thereof. The remainder of the bore is of a constant diameter generally equal to the crest diameter of threaded section 84 on the valve body. The flange 96 is provided with an L-shaped groove 102 in the forward end face thereof in surrounding relation to the in wall for closely receiving O-ring 92. When installed, the O-ring then provides a fluid seal at the area of threaded section 84. Tensile and impact testing of the nut 94 has shown that single-turn thread 100 provides high holding strength and a large resistance to loosening in a disposable container installation.

When the subject new dispenser valve A is installed on a disposable container (not shown), the container is disposed between the washer 90 and the O-ring seal 92 for preventing fluid from leaking out around the valve. Advancement of nut 94 on threaded section 84 effects the sealed connection between the valve and associated container. Since the valve operating mechanism comprised of handle 50 and seal member 74 is located downstream of the port 38, ie., on the "dry" side of valve A, no dynamic seals are necessary.

Preferably, both the valve body 10 and the seal member 74 are constructed of moldable plastic materials. The valve body may be made from a rigid polypropylene thermoplastic material which gives the capability for producing the valve with an integral hinge and handle. Such material also eliminates the possibility of contamination of the fluids being handled and is resistant to corrosion and staining.

The seal member 74 is preferably made from a soft, resilient thermoplastic elastomer. One preferred material is styrene-ethylene/butylene-styrene which has soft sealing qualities to assure a tight seal and memory properties to provide for a press-in retention and loaded seating of the seal. Such seal material has good resistance to long-term aging and permanent set, and also has physical properties which are highly stable across a 32° F.–140° F. range of end use temperatures of fluids dispensed through the valve. These fluids include warm and cold drinks, condiments, cleaning products, laboratory or industrial fluids, and the like.

The nut 94 is preferably made of a moldable plastic material, and the single thread system allows for simplified tooling and provides for easy extraction of the molded part. It also requires less material than a nut having a multi-turn thread system. Nut 94 is well suited for production by conventional injection molding techniques.

In one preferred embodiment of the present invention, the body first portion 12 is approximately 1.16 inches long while the body second portion 14 is approximately 1.37 inches in length. Moreover, in the body first portion, first bore 18 is circular with a 0.533 inch diameter and second bore 22 is square with a 0.375 inch width. Bore 34 of the body second portion is circular, having a diameter of 0.437 inches. The handle 50 is approximately 1.43 inches in length. It is to be appreciated, however, that the above dimensions are merely exemplary and that other dimensions could also be readily used without in any way departing from the overall intent or scope of the invention.

Valves constructed according to the subject invention have been subjected to prolonged endurance test cycling and have accumulated more than 196,000 operating cycles without failure. Pressure testing of the seal has shown tight sealing qualities at pressures several times greater than the gravity pressure heads at which the seal will normally be used in a bag-in-the-box or membrane type fluid container environment.

The valve body 10 with integral hinge 58 and handle 50, and the tubular seal member 74 can be easily produced by conventional molding techniques. Assembly of the valve is accomplished simply by pressing the seal member 74 into the bore 34 of the second tubular member with finger 60 received in loop 78. The overall design of the valve is readily adapted to automated assembly methods and has very low manufacturing costs. It is estimated that manufacturing costs are approximately 80% less than those of comparable valve constructions.

With reference now to the alternate embodiment of FIG. 6, the structure there shown is particularly suited for dispensing viscous products, such as ketchup, cooking oil, and the like. For ease of illustration and appreciation of this alternative, like components are identified by like numerals with a primed (') suffix and new components are identified by new numerals.

In this FIGURE, the valve A' has a valve body 10' comprised of first and second portions 12', 14' disposed in an angular relation to each other. In this instance, the angle is less than 90° to provide a gravity assist to the more viscous fluids. The first portion 12' is provided with a first end portion 16' and a second end portion 24' having a single diameter first passageway 110 extending therebetween. A plurality of axially elongated apertures 112 penetrate the side wall of first portion 12' to better facilitate entry of viscous fluid into bore 110.

The body second portion 14' has a first end portion 30' which, except for a small aperture 32', is substantially closed, and a second, open end portion 36'. A bore 34' extends between these end portions and defines a second passageway. A resilient tubular seal member 74' is closely received in bore 34'. This seal member may be made of the same thermoplastic material as the corresponding seal member 74 described in detail above with reference to the preferred embodiment.

Seal member 74' has an outer periphery 76' which is somewhat larger than the diameter of bore 34' in order to provide an interference fit as in the same manner previously described. The seal member is also provided with an inner loop portion 78' on its inner periphery 80', and the loop is adapted for cooperative association with a finger or stem portion 60' of a handle 50'.

In the FIG. 6 construction, handle 50' is also formed integral with the valve body 10' at a hinge or joint 58'. An outwardly extending flange 64' is, again, advantageously provided on the handle for limiting handle movement toward a valve open condition. Seal member 74' is joined to handle 50' by receipt of narrowed portion 62' in loop portion 78' and is actuated by pivoting handle 50' clockwise about hinge 58' in the view of FIG. 6 so that the seal member is shearingly flexed away from its normal sealing position with side wall 40' across the intersection of the first and second fluid passageways.

In this embodiment, a second stop member on the upper face of the handle manipulating portion is not included. Rather, a strengthening gusset 14 is provided at the interface area between the upper face and handle finger portion 60'. In some applications for the valve, gusset 114 may be sufficient to prevent inadvertent overstressing of hinge 58' when the valve is moved to the closed condition or when the handle is moved in the incorrect direction by a user. Gusset 114 is also adaptable to use in the embodiment of FIGS. 1–5.

Another alternative construction and arrangement for the handle is illustrated in FIG. 7. For ease of illustration and appreciation of this embodiment, like components are identified by like numerals with a double primed (") suffix.

In FIG. 7, the handle 50" comprises a separate component pivotally mounted to the valve body. In particular, the handle includes a first section 120 disposed outside the first end 30" of body second portion 14" and a reduced diameter or neck portion 122 positioned within the aperture 32". An elongated finger or stem portion 124 extends from neck portion 122 inwardly into the second passageway as defined by bore 34" and is cooperatively associated with tubular seal member 74" in the same manner previously described. Operation of the valve is also the same as previously described.

The invention has been described with reference to preferred and alternate embodiments. Obviously, modifications and alterations will occur to others upon a reading and understanding of this specification. It is intended to include all such modifications and alterations insofar as they come within the scope of the appended claims or the equivalents thereof.

Having thus described the invention, it is now claimed:

1. A dispensing valve comprising:

a body member including a first portion having a first passageway open at both ends and a second portion having a second passageway open at a first end and generally closed at a second end, said first passageway communicating with said second passageway at a port disposed along the side wall of said second passageway intermediate said first and second ends;

a handle operably associated with said body and extending at least partially into said second passageway from said generally closed second end, said handle being selectively moveable between valve open and closed conditions; and, a tube-like seal member received in said second passageway in a covering relationship with at least said port, and means for operatively connecting said handle to said seal member for causing said seal member to be shearingly shiftable between blocking and non-blocking relationships relative to said port in response to movement of said handle between said closed and open conditions, respectively, for controlling fluid flow between said first and said second passageways.

2. The valve of claim 1 wherein said handle is integral with said body and includes a manipulation portion located externally of said second passageway, an integral hinge portion interposed between said handle and said body member second portion whereby said handle is pivotally moved between said valve open and closed conditions, and a finger portion extending into said second passageway in operative association with the seal member.

3. The valve of claim 2 wherein one of said handle manipulation portion and body member second portion includes an outwardly protruding area defining a handle stop, said stop being cooperable with the other of said handle manipulation portion and body member second portion to limit pivotal movement of said handle in one of said valve open and valve closed conditions.

4. The valve as defined in claim 3 wherein a pair of outwardly protruding areas cooperable between said handle manipulation portion and body member second portion are included for defining handle stops to limit pivotal movement of said handle in both of said valve open and closed conditions.

5. The valve as defined in claim 3 wherein said outwardly protruding area comprises a flange on said handle manipulation portion for limiting handle movement in said valve open condition.

6. The valve of claim 2 wherein said body member first portion includes an exteriorly threaded portion at an outer end thereof spaced from said second portion, and a radially outward extending flange axially spaced from said outer end.

7. The valve of claim 6 further including seal means and a nut received on said threaded portion for accommodating sealed mounting of said valve to associated structure interposed between said flange and nut.

8. The valve of claim 6 wherein an outer periphery of said first portion adjacent said flange on the other side thereof from said threaded section has a plurality of flat surfaces oriented for providing a wrench grip.

9. The valve of claim 1 wherein said generally closed second passageway second end includes an aperture through which said handle extends, said handle having a necked portion disposed in said aperture for retaining said handle therein and accommodating pivoting movement of said handle between said valve open and closed conditions.

10. The valve of claim 1 wherein said seal member is configured and dimensioned to be closely received in said second passageway in an interference fit therewith.

11. The valve of claim 1 wherein said seal member includes a connector portion on the interior thereof, a finger portion of said handle located in said second passageway communicating with connector portion for placing said handle and seal member in operative association with each other whereby movement of said handle causes corresponding movement of said seal member.

12. The valve of claim 1 wherein said body and said tube-like seal member are both constructed of plastic material.

13. The valve of claim 10 wherein said body is comprised of polypropylene and said seal member is comprised of a thermoplastic elastomer.

14. A dispensing valve for a fluid-holding container comprising:

a valve body including a first portion having a first fluid passageway and a second portion having a second fluid passageway terminating in a first open end and a second generally closed second end, said first passageway communicating with said second passageway at a port in the side wall of said second passageway;

a handle operatively associated with said body second portion and having a finger portion extending into said second passageway, said handle being selectively moveable between valve open and closed conditions;

a resiliently deformable seal member closely disposed in said second passageway in a normally closing and overlying relationship with said port, said seal member being shearingly deformable away from said port and including a connecting area thereon operatively associated with said handle finger for effecting shearing movement of said seal member to an opening relationship with said port in response to movement of said handle; and, mounting means adapted for mounting said valve body to an associated container.

15. The fluid valve of claim 14 wherein said seal member has a tube-like conformation, and is closely received and retained in said second passageway by an interference fit.

16. The fluid valve of claim 14 wherein said mounting means includes an exteriorly threaded section on an outer end of said body first portion and a nut adapted for threaded receipt thereon.

17. The fluid valve of claim 16 wherein said mounting means further includes a radial flange axially spaced from said body first portion outer end adjacent said threaded section, and said first portion including plural flat surfaces on the other side of said flange from said threaded section for defining a wrench grip.

18. A self-closing valve for dispensing fluid products, comprising:

a body member including a first portion having a first passageway and a second portion having a second passageway with said first and second passageway being disposed in fluid communication to each other at a port disposed in the side wall of said second passageway;

a handle having a finger portion extending into said second passageway;

means for operatively mounting said handle to said body for accommodating selective handle movement between valve open and closed conditions;

a resilient seal member closely received in said second passageway and having a normal position disposed in covering relation to said port, said seal member being resiliently and shearingly deformable to a second position in uncovering relation to said port adapted to allow fluid flow between said first passageway to said second passageway; and, means for operatively connecting said handle finger portion to said seal member for allowing said seal member to be shearingly moved between said normal and second positions in response to movement of said handle between said valve closed and open conditions, respectively.

19. The dispensing valve of claim 18 wherein said connecting means includes an integral loop on a surface of said seal member remote from said port, said loop retainingly receiving said handle finger portion.

20. The dispensing valve of claim 18 wherein said mounting means includes a hinge for allowing pivotal movement of said handle between said valve open and closed positions, said valve body, handle, and hinge being integrally formed with each other.

21. The dispensing valve of claim 18 wherein said second passageway is substantially closed at one end thereof and has an aperture through which said handle extends, said handle having a necked area retainingly received in said aperture and being pivotally moveable between said valve open and closed conditions.

22. The dispensing valve of claim 18 wherein said seal member is constructed of an elastomeric material.

23. The dispensing valve of claim 22 wherein said seal member has a generally tube-like conformation dimensioned to be received in said second passageway with an interference fit to prevent dislodgement therefrom.

24. The dispensing valve of claim 18 wherein said handle further includes a manipulation portion located externally of said body, said valve including means cooperable between said handle and body member for limiting said handle in one direction of movement between said valve open and closed conditions.

25. The dispensing valve of claim 24 including means cooperable between said handle and body member for limiting said handle in both directions of movement between said valve open and closed conditions.

26. The dispensing valve of claim 18 wherein said first portion includes an outwardly extending flange area adapted to limit the axial insertion of said first portion into an associated container.

* * * * *